US007999778B2

(12) United States Patent
Lee

(10) Patent No.: US 7,999,778 B2
(45) Date of Patent: Aug. 16, 2011

(54) APPARATUS AND METHOD FOR DRIVING LCD

(75) Inventor: Chang Hwan Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1504 days.

(21) Appl. No.: 11/418,826

(22) Filed: May 4, 2006

(65) Prior Publication Data

US 2007/0146287 A1 Jun. 28, 2007

(30) Foreign Application Priority Data

Dec. 27, 2005 (KR) ..... 10-2005-0130761

(51) Int. Cl.
*G09G 3/36* (2006.01)

(52) U.S. Cl. ..... 345/89; 345/55; 345/204; 345/98

(58) Field of Classification Search ..... 345/89, 345/55, 204, 98
See application file for complete search history.

(56) References Cited

U.S. PATENT DOCUMENTS 6,429,844 B1 * 8/2002 Yoon ..... 345/98
6,806,854 B2 * 10/2004 Cairns et al. ..... 345/87
6,825,826 B1 * 11/2004 Mikami et al. ..... 345/98

* cited by examiner

*Primary Examiner* — Richard Hjerpe
*Assistant Examiner* — Leonid Shapiro
(74) *Attorney, Agent, or Firm* — Brinks Hofer Gilson & Lione

(57) ABSTRACT

An apparatus for driving a liquid crystal display device includes a liquid crystal display panel and a controller for controlling division and latch of data, and controlling the sampling of the divided data. A data driver divides input digital data into a number of digital data under control of the controller, converts the latched digital data into a number of analog data, and then simultaneously samples the analog data to supply to the data lines.

17 Claims, 11 Drawing Sheets

APPARATUS AND METHOD FOR DRIVING LCD

This application claims the benefit of Korean Patent Application No. P2005-0130761 filed on Dec. 27, 2005 herein incorporated by reference.

BACKGROUND

1. Technical Field

The technical field relates to a liquid crystal display device, and more particularly to an apparatus and method for driving a liquid crystal display device that is adaptive for greatly reducing the sampling frequency of data which is supplied to a liquid crystal display panel.

2. Description of the Related Art

A liquid crystal display device controls the light transmittance of liquid crystal cells in accordance with a video signal to display a picture, and an active matrix type liquid crystal display device where a switching device is formed at each liquid crystal cell is advantageous in realizing a motion picture because it is possible to actively control the switching device. As shown in FIG. 1, the switching device used in the active matrix type liquid crystal display device is mainly a thin film transistor (hereinafter, referred to as "TFT")

Referring to FIG. 1, the active matrix type liquid crystal display device converts digital input data into an analog data voltage on the basis of a gamma reference voltage to supply a data line DL, and simultaneously supplies a scan pulse to a gate line GL to charge a liquid crystal cell Clc.

A gate electrode of the TFT is connected to the gate line GL, a source electrode is connected to the data line DL, and a drain electrode of the TFT is connected to a pixel electrode of the liquid crystal cell Clc and one electrode of a storage capacitor Cst.

A common voltage Vcom is supplied to a common electrode of the liquid crystal cell Clc.

The storage capacitor Cst is charged with a data voltage supplied from the data line DL when the TFT is turned on, and acts to fixedly keep the voltage of the liquid crystal cell Clc.

If a scan pulse is applied to the gate line GL, the TFT is turned on to form a channel between the source electrode and the drain electrode, thereby supplying a voltage on the data line DL to the pixel electrode of the liquid crystal cell Clc. At this moment, liquid crystal molecules of the liquid crystal cell Clc have their arrangement changed by an electric field between the pixel electrode and the common electrode to modulate an incident light.

The configuration of the liquid crystal display device of the related art having the pixels with such a structure is described as shown in FIG. 2.

FIG. 2 is a configuration diagram of a driving apparatus of a liquid crystal display device of the related art.

Referring to FIG. 2, a driving apparatus 100 of the liquid crystal display device of the related art includes a liquid crystal display panel 110 where data lines DL1 through DLm cross gate lines GL1 through GLn and a thin film transistor TFT for driving a liquid crystal cell Clc is formed at each of the crossing parts and a data driver 120 for supplying data to the data lines DL1 through DLm of the liquid crystal display panel 110. Driving apparatus 100 also includes a gate driver 130 for supplying a scan pulse to the gate lines GL1 through GLn of the liquid crystal display panel 110 and gamma reference voltage generator 140 for generating a gamma reference voltage to supply to the data driver 120. The driving apparatus 100 further includes a backlight assembly 150 for irradiating light of the liquid crystal display panel 110 and an inverter 160 for applying an AC voltage and current to the backlight assembly 150. The driving apparatus 100 additionally includes a common voltage generator 170 for generating a common voltage Vcom, shown in FIG. 1, which is supplied to a common electrode of the liquid crystal cell Clc of the liquid crystal display panel 110. The driving apparatus 100 also includes agate drive voltage generator 180 for generating a gate high voltage VGH and a gate low voltage VGL, which are supplied to the gate driver 130, and a timing controller 190 for controlling the data driver 120 and the gate driver 130.

The liquid crystal display panel 110 has liquid crystal injected between two glass substrates. The data lines DL1 through DLm cross the gate lines GL1 through GLn on a lower glass substrate of the liquid crystal display panel 110. A TFT is formed at each of the crossing parts of the data lines DL1 to DLm and the gate lines GL1 to GLn. The TFT supplies data on the data lines DL1 to DLm to the liquid crystal cell Clc in response to a scan pulse. A gate electrode of the TFT is connected to the gate line GL1 to GLn, and a source electrode of the TFT is connected to the data line DL1 to DLm. A drain electrode of the TFT is also connected to a storage capacitor Cst and a pixel electrode of the liquid crystal cell Clc.

The TFT is turned on in response to the scan pulse supplied to a gate terminal using the gate lines GL1 through GLn. Video data on the data lines DL1 through DLm is supplied to the pixel electrode of the liquid crystal cell Clc when turning on the TFT.

The data driver 120 supplies the data to the data lines DL1 through DLm in response to a data drive control signal DDC supplied from the timing controller 190, samples a digital video data RGB supplied from the timing controller 190 for latching, and then converts the gamma reference voltage supplied from the gamma reference voltage generator 140 into an analog data voltage. The analog data voltage can express the gray level in the liquid crystal cell Clc of the liquid crystal display panel 110 to supply the data lines DL1 to DLm.

The gate driver 130 sequentially generates the scan pulse, i.e., a gate pulse, to supply the gate lines GL1 through GLn in response to a gate drive control signal GDC and a gate shift clock GSC supplied from the timing controller 190. The gate driver 130 then determines the high level voltage and the lower level voltage of each scan pulse in accordance with the gate high voltage VGH and the gate low voltage VGL supplied from the gate drive voltage generator 180.

The gamma reference voltage generator 140 receives the highest potential supply voltage VDD in the supply voltages provided by the liquid crystal display panel to generate a positive gamma reference voltage and a negative gamma reference voltage, which are outputted to the data driver 120.

The backlight assembly 150 is disposed at the rear surface of the liquid crystal display panel 110, and is made to emit light from the AC voltage and current supplied from an inverter 160. The backlight assembly 150 is configured to irradiate the light to each pixel of the liquid crystal display panel 110.

The inverter 160 generates a square wave signal and then converts the square wave signal into a triangular wave signal. The inverter 160 then compares the triangular wave signal with a DC supply voltage supplied from the system to generate a burst dimming signal, which is proportional to the comparison result. If the inverter 160 generates the burst dimming signal determined in accordance with the internal square wave signal, a drive integrated circuit (not shown), which controls the generation of the AC voltage and current within the inverter 160, controls the generation of the AC voltage and current supplied to the backlight assembly 150 in accordance with the burst dimming signal.

The common voltage generator 170 receives the high potential supply voltage VDD to generate the common voltage Vcom, which is supplied to the common electrode of the liquid crystal cell Clc provided in each pixel of the liquid crystal display panel 110.

The gate drive voltage generator 180 receives the high potential supply voltage VDD to generate the gate high voltage VGH and the gate low voltage VGL, which are supplied to the gate driver 130. The gate drive voltage generator 180 generates the gate high voltage VGH, which is higher than a threshold voltage of the TFT provided at each pixel of the liquid crystal display panel 110, and generates the gate low voltage VGL, which is lower than the threshold voltage of the TFT. The generated gate high voltage VGH and the generated gate low voltage VGL are each used for determining a high level voltage and a low level voltage of the scan pulse generated by the gate driver 130.

The timing controller 190 supplies the digital video data RGB supplied from a digital video card (not shown) to the data driver 120, and generates the data drive control signal DDC and the gate drive control signal GDC by use of horizontal/vertical synchronization signals H, V in accordance with a clock signal CLK, thereby supplying the gate driver 120 and the gate driver 130 respectively. The data drive control signal DDC may include source shift clock SSC, source start pulse SSP, polarity control signal POL, source output enable signal SOE, or other similar signals. The gate drive control signal GDC may include gate start pulse GSP, gate output enable GOE, or other similar signals.

In one example, a semiconductor layer formed on the TFT of a pixel matrix array is formed using an amorphous Si. In another example, the semiconductor layer formed on the TFT of a pixel matrix array is formed using a Poly Si.

FIG. 3 is a schematic diagram of a data driver for supplying an analog data voltage to data lines in a liquid crystal display device using Poly Si as the semiconductor layer of the pixel matrix array.

Referring to FIG. 3, the data driver 120 for driving a data line of the liquid crystal display device using Poly Si as a semiconductor layer includes a decoder 121 for decoding inputted digital video data; a D/A converter 122 for converting the decoded digital video data into an analog data; and a sampling part 123 for sampling the analog data which is outputted by the D/A converter 122.

The decoder 121 decodes the inputted digital video data outputted by the timing controller 190 of FIG. 2 as output to the D/A converter 122.

The D/A converter 122 converts the digital video data decoded by the decoder 121 into the analog data as output to the sampling part 123.

The sampling part 123 sequentially samples the analog data outputted by the D/A converter 122 according to an output of a shift register 124, and supplies the sampled data to the data lines DL1 through DLm. The analog data is sequentially supplied to the (m)th data line DLm from a first data line D1 within a first horizontal time period. Accordingly, the output SR1 through SRm of the shirt register 124 is sequentially generated within the first horizontal time period. In other words, an analog data voltage is supplied to the first data line DL1 when the first pulse SR1 is generated, and the analog data voltage is supplied to the second data line DL2 when the second pulse SR2 is generated among the output of the shift register 124. The analog data voltage is sequentially supplied to the (m)th data line DLm from the first data line DL1 during the first horizontal time period according to a sequential supplying method.

As described above and shown in FIG. 4, the data sampling time is relatively long within the first horizontal time period, such that one analog data voltage charged into the data line is approximately an m/l horizontal time period 1H.

Referring to FIG. 5, the liquid crystal display device of the related art, the data supply time t1 for supplying the data to each data lines DL1 through DLm is greatly reduced. Thus, a data supply A2 cannot keep up with the output A1 of the D/A converter 122. As a result, the charge time in each pixel formed in the liquid crystal display panel 110 becomes short and the brightness of a display image is low. Hence, distortion is generated in the screen.

SUMMARY

An apparatus for driving a liquid crystal display device includes a liquid crystal display panel and a controller for controlling division and latch of data, and controlling the sampling of the divided data. A data driver divides input digital data into a number of digital data under control of the controller, converts the latched digital data into a number of analog data, and then simultaneously samples the analog data to supply to the data lines.

BRIEF DESCRIPTION OF THE DRAWINGS

These and other aspects of the disclosure will be apparent from the following detailed description of the examples shown in the accompanying drawings, in which.

DETAILED DESCRIPTION

Reference will now be made in detail to the examples, which are illustrated in the accompanying drawings. Wherever possible, the same reference numbers will be used throughout the drawings to refer to the same or like parts.

Figure 1:
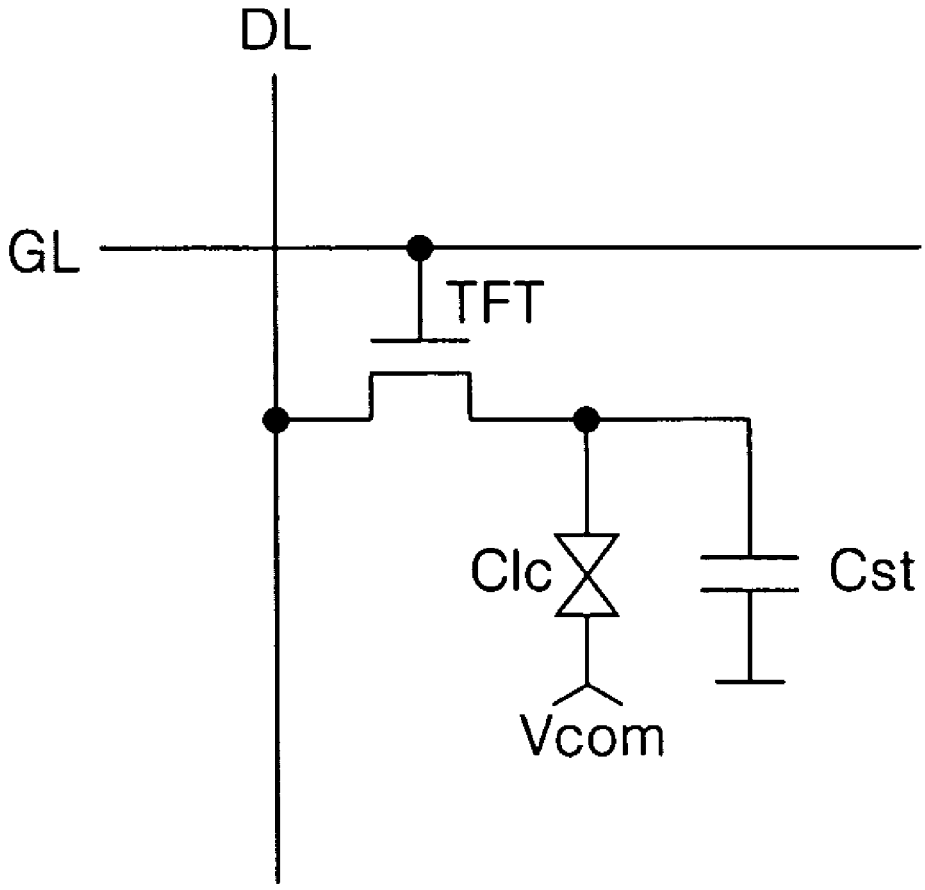
FIG. 1 RELATED ART
FIG. 1 is a diagram of a pixel formed in a general liquid crystal display device.
Figure 2:
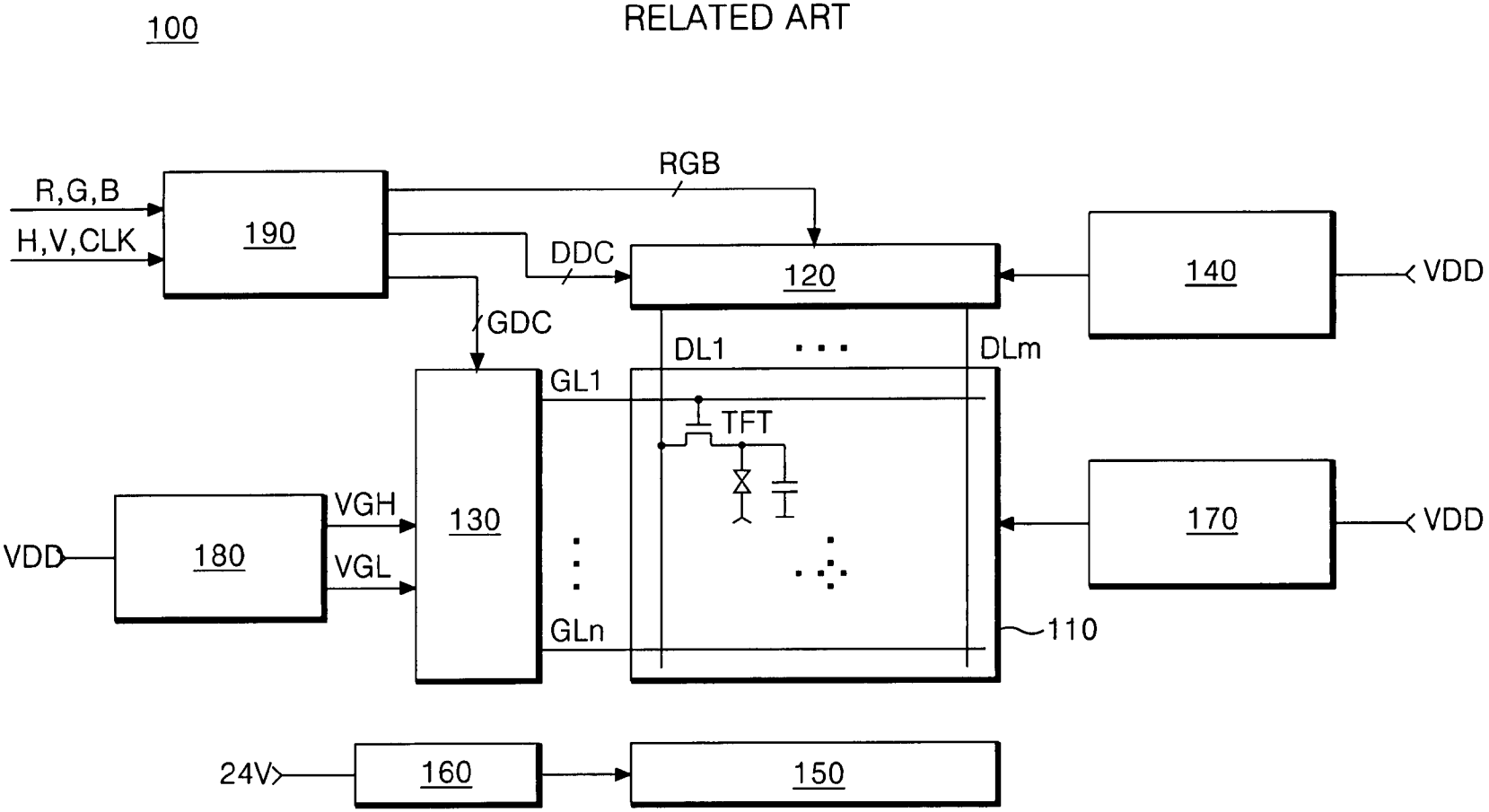
FIG.2 RELATED ART
FIG. 2 is a diagram of a driving apparatus of a liquid crystal display device of the related art.
Figure 3:
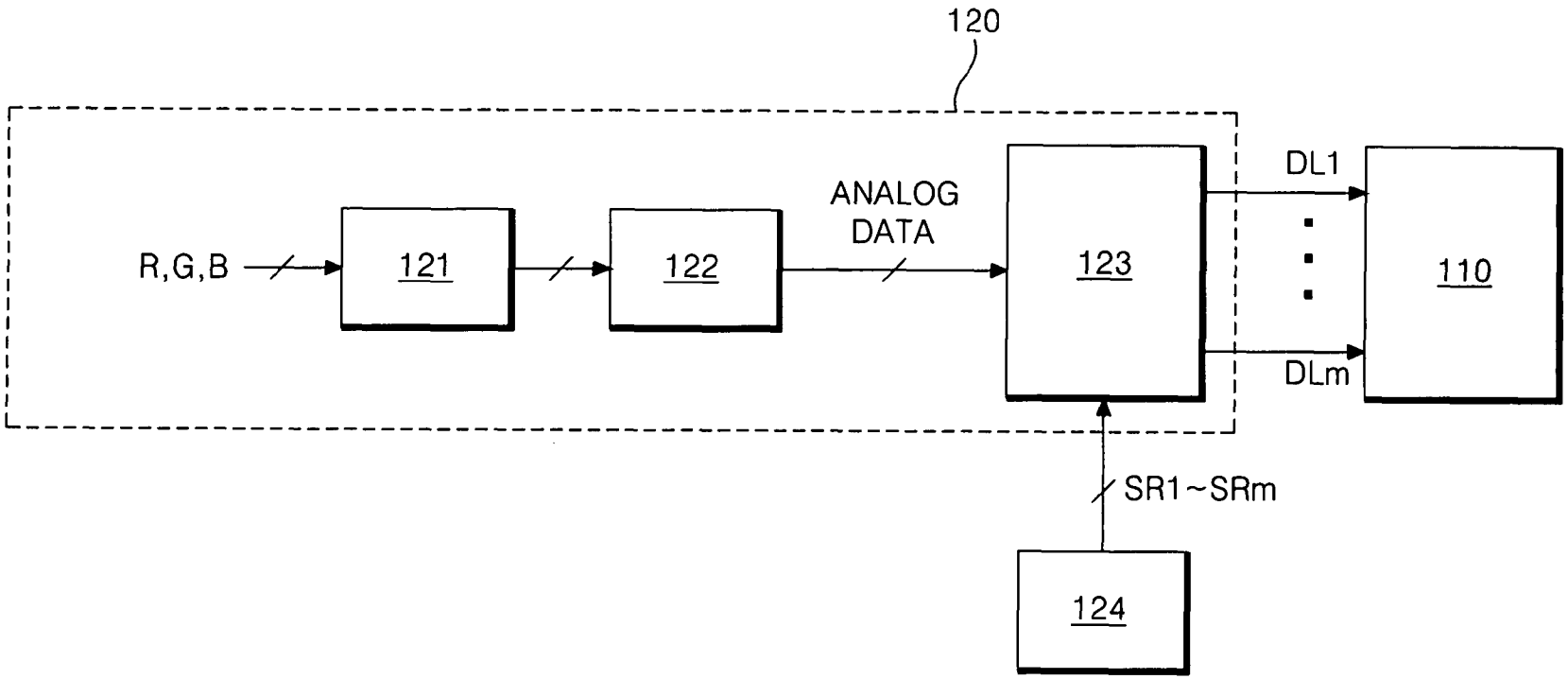
FIG. 3 RELATED ART
FIG. 3 is a diagram of a data driver included in the driving apparatus of the related art.
Figure 4:
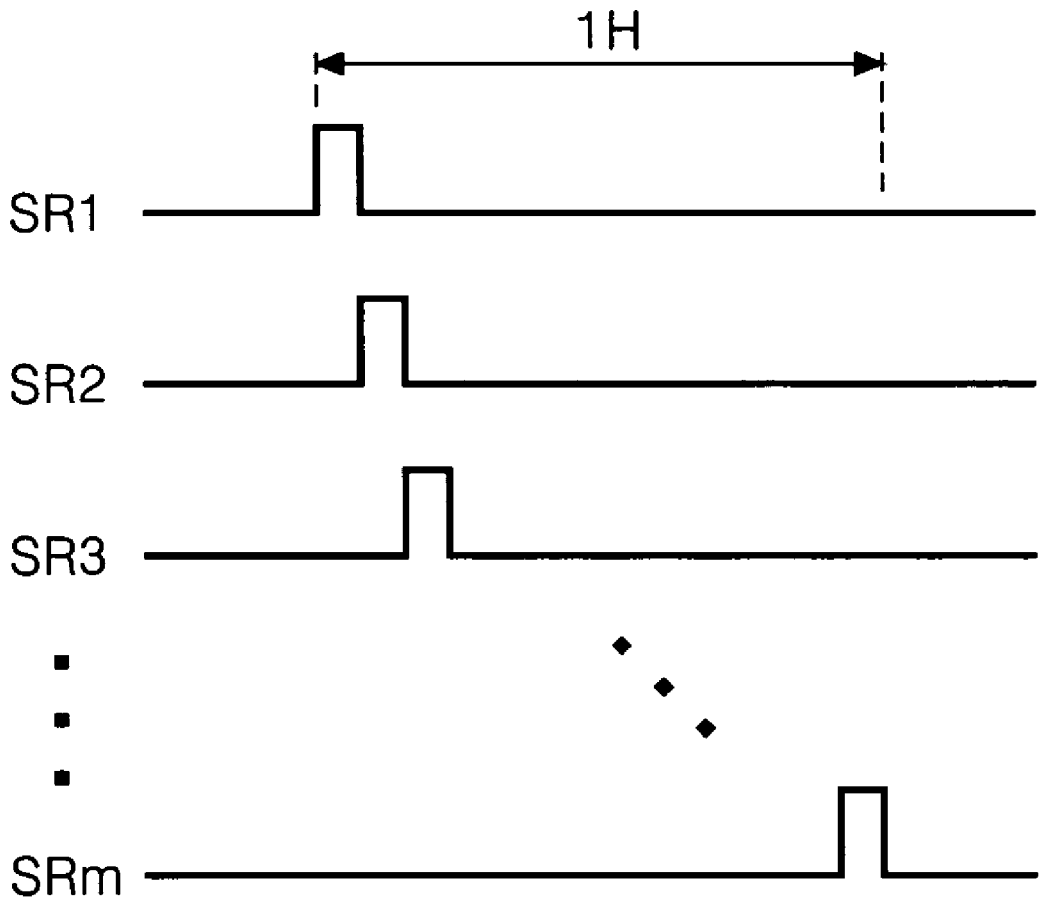
FIG. 4 RELATED ART
FIG. 4 is a waveform diagram showing an output of the shift register in FIG. 3.
Figure 5:
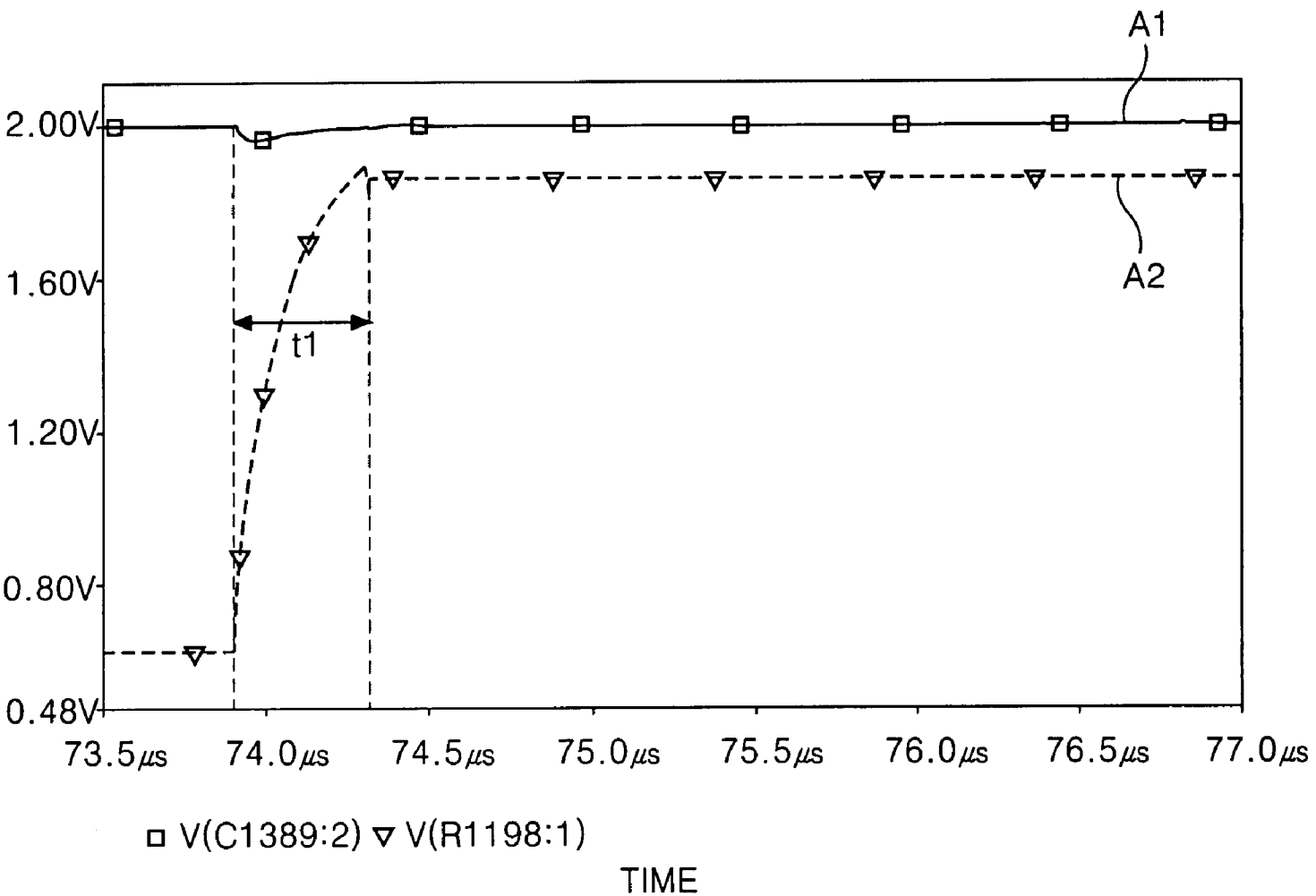
FIG. 5 RELATED ART
FIG. 5 is a diagram of a data supply time of the data driver included in the driving apparatus of a related art liquid crystal display device.
Figure 6:
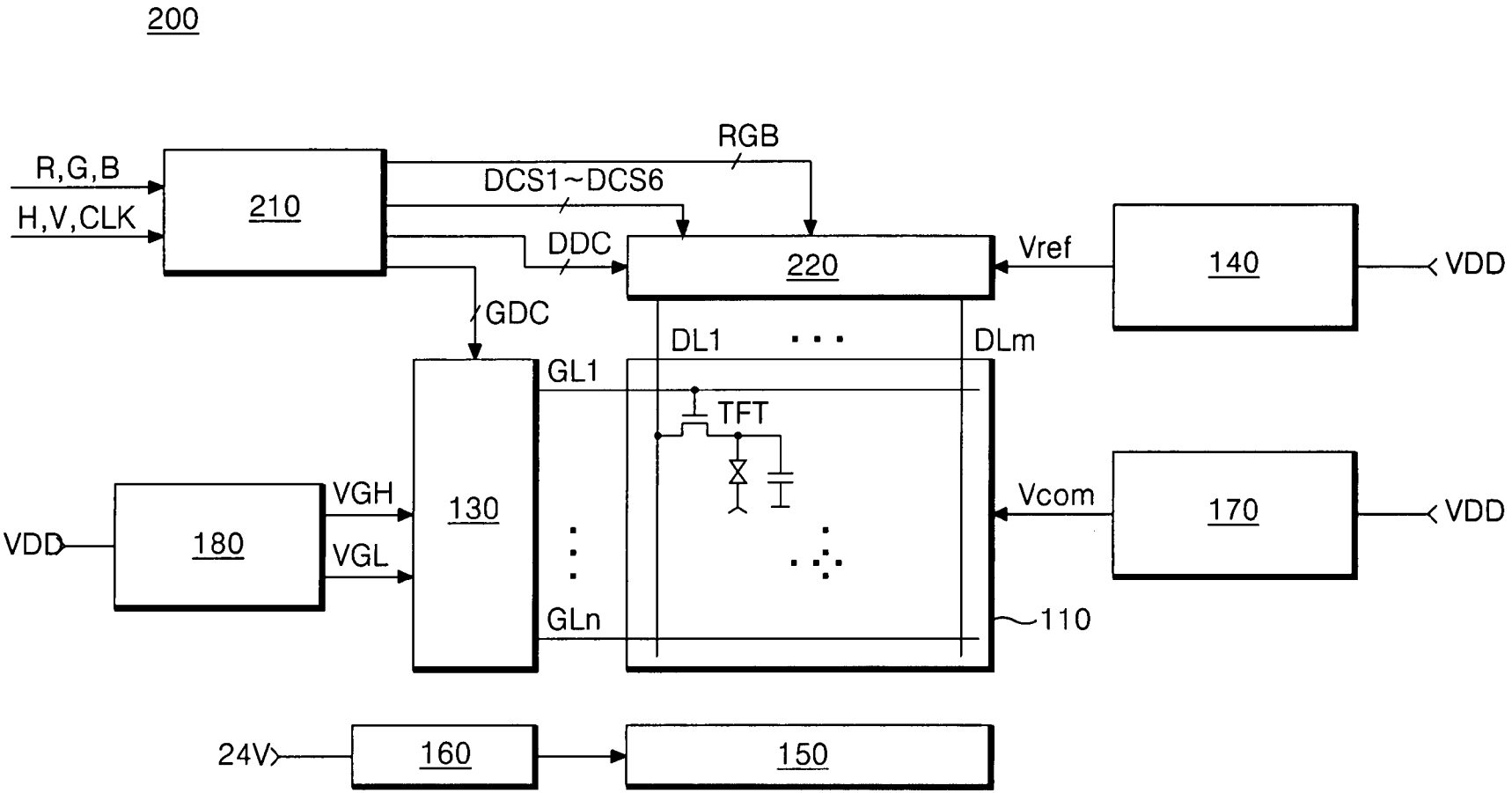
FIG. 6 is a diagram of one example of a driving apparatus of a liquid crystal display device.

Referring first to FIG. 6, a driving apparatus 200 of a liquid crystal display device includes a liquid crystal display panel 110, a data driver 220, a gate driver 130, a gamma reference voltage generator 140, a backlight assembly 150, an inverter 160, a common voltage generator 170 and a gate drive voltage generator 180.

A semiconductor layer is formed using a Poly Si semiconductor layer in order to increase mobility of an electric charge in the TFTs provided on a pixel matrix of the liquid crystal display panel 110.

The driving apparatus 200 of the liquid crystal display device shown in FIG. 6 includes a timing controller 210, which controls division and latching of data and controls the sampling of a plurality of divided data. The driving apparatus 200 also includes a data driver 220 that divides digital data input under control of the timing controller 210 into a plurality of digital data to latch and converts the latched digital data into a plurality of analog data. The data driver 220 then samples the analog data simultaneously to supply the data lines DL1 through DLm.

The timing controller 210 supplies the digital video data RGB supplied from a digital video card (not shown) to the data driver 220, and generates the data drive control signal DDC and the gate drive control signal GDC by use of horizontal/vertical synchronization signals H, V using a clock signal CLK. The timing controller 210 supplies the data driver 120 with the data drive control signal DDC and supplies the gate driver 130 with the gate driver control signal GDC. The data drive control signal DDC may include source shift clock SSC, source start pulse SSP, polarity control signal POL, source output enable signal SOE, or other similar signals. The gate drive control signal GDC may include gate start pulse GSP, gate output enable GOE, or other control signals.

Further, the timing controller 210 sequentially supplies division control signals DCS1 through DCS6 to the data driver 210 to control the data division, and controls the shift register within the data driver to control the sampling of the divided analog data.

When the digital data RGB is input to the data driver 220, the data driver 220 decodes the inputted digital data RGB, and divides the decoded digital data into an m number (where m is a natural number of 2 or more) of digital data in accordance with the division control signals DCS1 to DCSm for latching. The data driver 220 then converts the m number of divided digital data into m number of analog data.

The data driver 220 simultaneously samples the m number of the converted analog data in accordance with the sampling control signal SCS, i.e., the m number of analog data is sampled through a sample process of the m/k (k is less than m, integer) times, to supply the data lines DL1 through DLm formed in the liquid crystal display panel 110. In one example, the value assigned to 'k' is '6'. A gamma reference voltage Vref from a gamma reference voltage generator 140 is supplied to the data driver 220.

While the timing control 210 controls the function of division, latching and sampling of the data driver 220, it is not limited thereto, and it is possible to control the division, latching and sampling function of the data driver 220 through a separate controller (not shown).

A detail description for the data driver 220 is further described with reference to FIG. 7.

Figure 7:
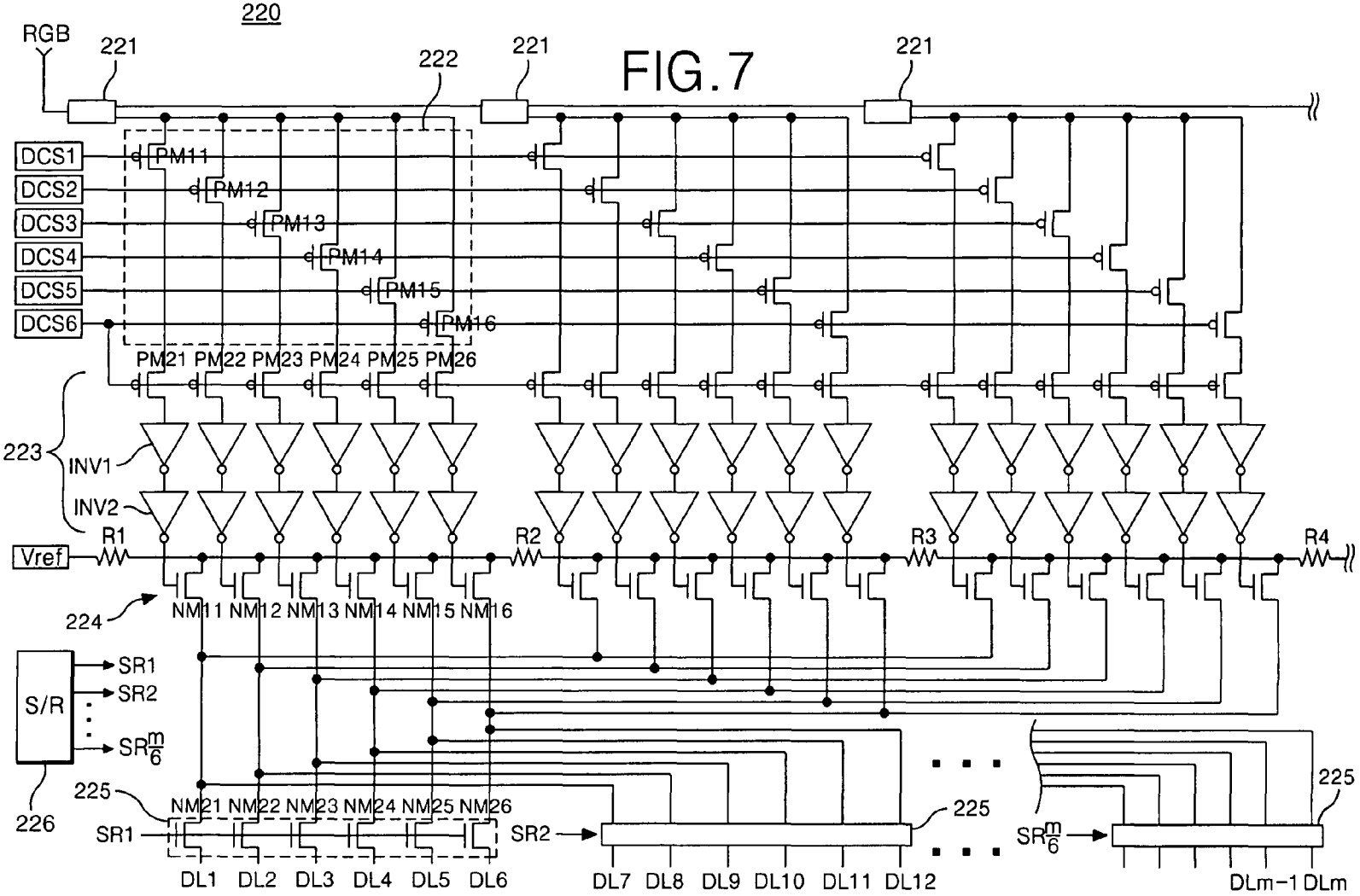
FIG. 7 is a circuit diagram of the data driver included in the driving apparatus of the liquid crystal display device shown in FIG. 6.

As shown in FIG. 7, the data driver 220 includes a decoder 221 for decoding the input digital video data and a data dividing part 222 for dividing the decoded digital data. In the example shown in FIG. 7, the data dividing part 222 divides the decoded data lines into 6 lines of digital data in accordance with division control signals DCS1 to DCSm. The data driver 220 also includes a latcher 223 for latching the 6 lines of the divided digital data and a D/A converter 224 for converting the 6 lines of the latched digital data into the 6 lines of the analog data. The data driver 220 further includes a sampling part 225 for simultaneously sampling the 6 number of the analog data in accordance with the sampling control signal SR1~SRm/6 to supply to the data lines DL1 to DLm.

The decoder 221 decodes the digital data input from the timing controller 210 to select anyone of a plurality of data dividing part 222 corresponding to a digital data value, and supplies the digital data to the selected data dividing part 222.

The data dividing part 222 includes a first set of six PMOS transistors PM11 through PM16, which divide the output signal of the decoder 221 into a plurality of output signals. The first through sixth dividing control signals DCS1 through DCS6 of the timing controller 210 are supplied to a gate electrode of the first through the sixth PMOS transistors PM11 through PM16. A source electrode of each of the first through the sixth PMOS transistors PM11 through PM16 are commonly connected to an output element of the decoder 221, and a drain electrode of each of the first through the sixth PMOS transistors PM11 through PM16 are connected to an input element of the latcher 223 on a one-to-one relationship. The first through the sixth PMOS transistors PM11 through PM16 are sequentially turned-on by the first through sixth dividing control signals DCS1 through DCS6 in FIG. 8 to supply a digital data from the data dividing part 222 to the latcher 223.

Figure 8:
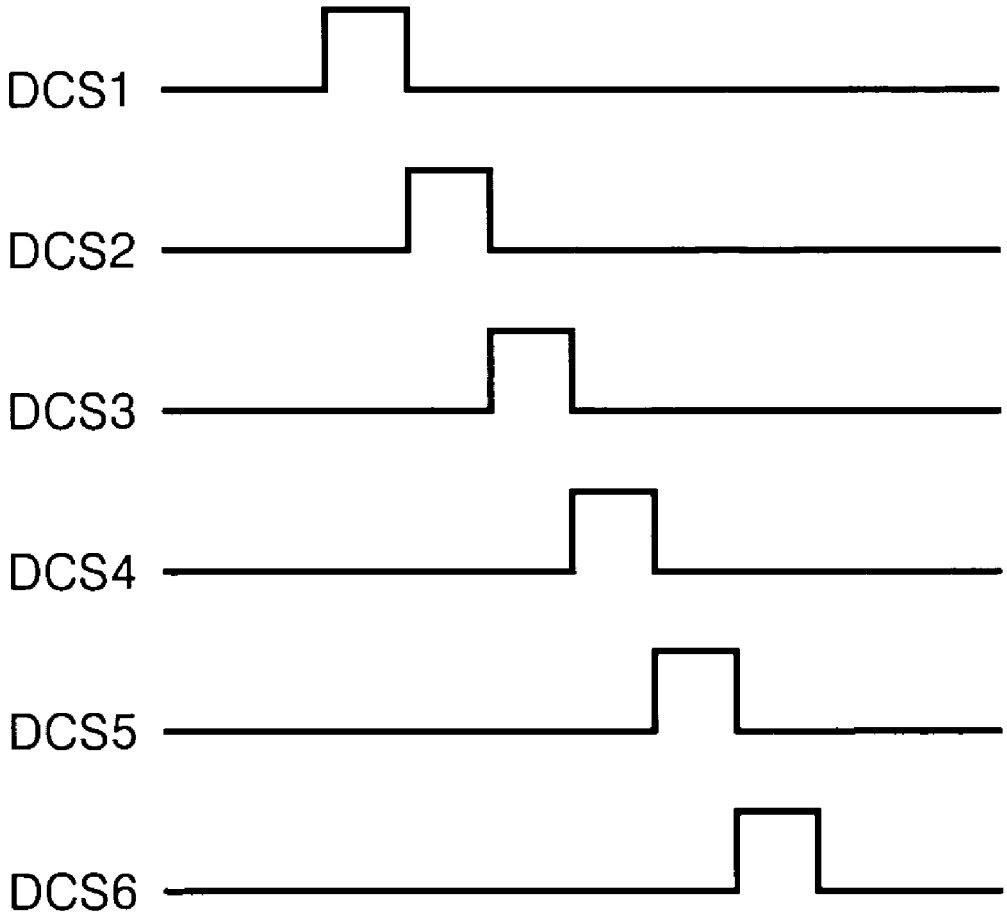
FIG. 8 is a timing diagram showing division control signals in FIG. 7.

For example, as shown in FIG. 8, if the first through sixth dividing control signals DCS1 through DCS6 are sequentially generated in the timing controller 210, firstly, the first PMOS transistor PM11 is turned on by the first dividing control signal DCS1 to supply the digital data to a first input element of the latcher 223. Next, the second through the sixth PMOS transistors PM12 through PM16 are sequentially turned-on by the second through sixth dividing control signals DCS2 through DCS6 to supply a digital data to the second and sixth output element of the latcher 223. As a result, one digital data outputted from the decoder 221 is sequentially switched by the eleventh through the sixteenth PMOS transistors PM11 through PM16 to divide the 6 lines of the divided digital data.

The latcher 223 includes a second set of six PMOS transistors PM21 through PM26 for simultaneously switching the 6 lines of the divided digital data, a first inversion part INV1 for firstly inverting the 6 lines of the divided digital data outputted from the first through the sixth PMOS transistors of the second set PM21 through PM26 and a second inversion part INV2 for secondly inverting the 6 lines of the divided digital data outputted from the first inversion part INV1.

A gate electrode of each PMOS transistors of the second set of PMOS transistors PM21 through PM26 are commonly connected to an output element of the sixth dividing control signal DCS6, and a source electrode of each of the PMOS transistors of the second set of PMOS transistors PM21 through PM26 are connected to a corresponding drain electrode of each of the PMOS transistors of the first set of PMOS transistors PM11 through PM16 on a one-to-one relationship. The drain electrode of each of the PMOS transistors of the second set of PMOS transistors PM21 through PM26 is connected in series to the first inversion part INV1 on a one-to-one relationship.

The each of the PMOS transistors of the second set of PMOS transistors PM21 through PM26 are simultaneously turned-on by the sixth dividing control signal DCS6 along with the sixth PMOS transistor of the first set of PMOS transistors PM16 lastly turned-on at the data dividing part 222 to simultaneously supply the 6 lines of the divided digital data to the input element of the first inversion parts INV1.

Figure 9:
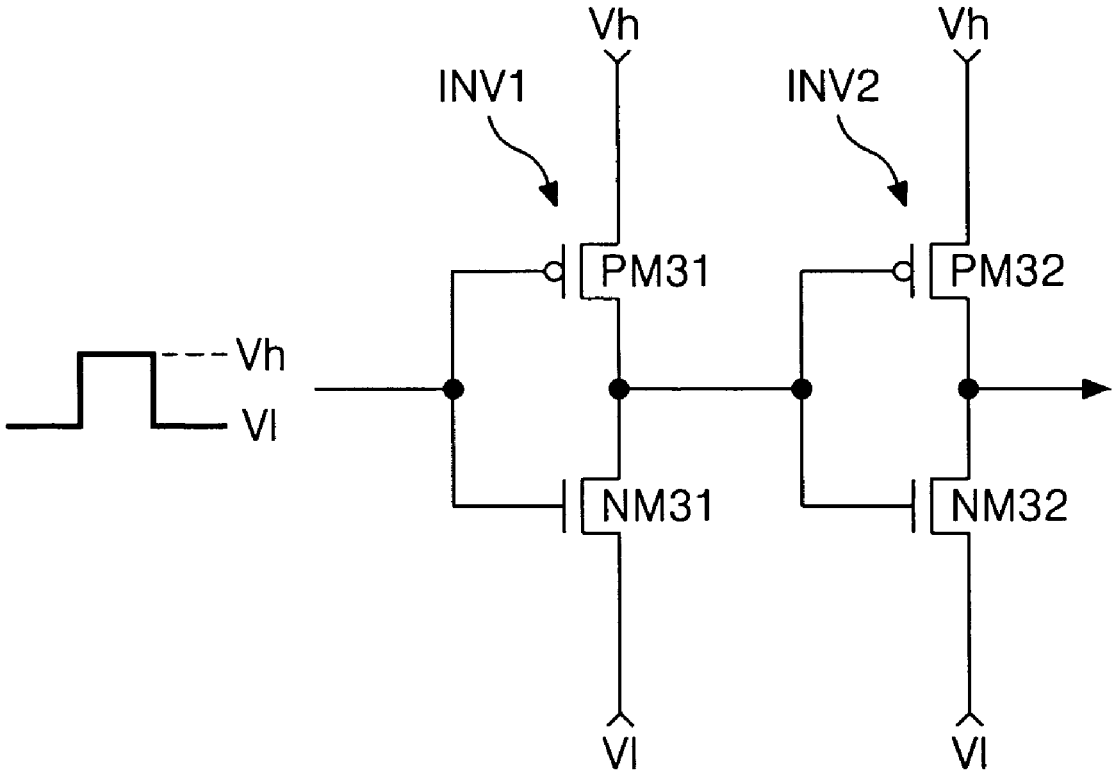
FIG. 9 is a circuit diagram showing a detailed circuit configuration of the inversion parts in FIG. 7.

Referring to FIG. 9, the first inversion parts INV1 includes a PMOS transistor PM31 connected in a push-pull type, and an NMOS transistor NM31. In the first inversion part INV1, when the output voltage of the second set of PMOS transistors PMOS transistors PM21 through PM26 is a high logic voltage V1, an output is generated by using a direct current power, that is, a low logic voltage V1 while when the output voltage of the second set of PMOS transistors PM21 through PM26 is a low logic voltage V1, the output is generated by using a direct current power, that is, a high logic voltage V1 to inverse a logic value of the digital data voltage. The first inversion parts INV1 separates the input element thereof with the output element thereof. Thus, it becomes possible to prevent a phenomenon in which the output of the second set of PMOS transistors PM21 through PM26 is changed.

For example, if each of the PMOS transistors of the second set of PMOS transistors PM21 through PM26 are directly connected to the D/A converter 224 without the first inversion parts INV1, a voltage dropping is generated by a load of the liquid crystal display panel in the digital data outputted by the each of the PMOS transistors PM21 through PM26. As a result, an over-shoot or an under-shoot is inputted into the D/A converter 224, so that it becomes possible to generate a malfunction of the D/A converter 224.

Referring to FIG. 9, the second inversion part INV2 includes a second PMOS transistor PM32 connected in a push-pull type, and a second NMOS transistor NM32. In the second inversion part INV2, when the output voltage of the first inversion part INV1 is a high logic voltage Vh, an output is generated by using a direct current power, that is, a low logic voltage V1. Conversely, when the output voltage of the second inversion part INV2 is a low logic voltage V1, the output is generated by using a direct current power, that is, a high logic voltage V1 to inverse a logic value of the digital data voltage. The second inversion part INV2 inverses the digital data, which has had a logic value inversed by the first inversion part INV1, so that the digital data has a normal logic value when it is supplied to the D/A converter 224.

As a result, the first and second inverters INV1 and INV2 play a role as a buffer in order not to generate the voltage dropping in an input digital data by an output element load.

The D/A inverter 224 includes dividing resistances R1 through R4 for dividing the gamma reference voltage, and the NMOS transistors NM11 through NM16 are arranged between adjacent dividing resistances R1 and R2.

The dividing resistances R1 through R4 divide the gamma reference voltage Vref from the gamma reference voltage generator 140 to generate an analog data voltage corresponding to each gray scale level of the digital data.

The gate electrode of each of the NMOS transistors NM11 through NM16 are connected to a corresponding output element of the second inverters INV2 on a one-to-one relationship between the adjacent dividing resistances R1 and R2, and the source electrode of each of the NMOS transistors NM11 through NM16 are connected to 6 lines of analog gamma voltage output nodes existing between the dividing resistances on a one-to-one relationship. The drain electrodes of each of the NMOS transistors NM11 through NM16 are also connected to the input element of the sampling part 225 on a one-to-one relationship. The NMOS transistors NM11 through NM16 allow the analog gamma voltage output nodes to be selectively connected to the input elements of the sampling part 225 to convert the digital data into the analog data according to the output of the second inversion part INV2.

The sampling part 225 includes a second set of six NMOS transistors NM21 through NM26 for simultaneously sampling the analog data according to the output of the shirt register 226.

Figure 10:
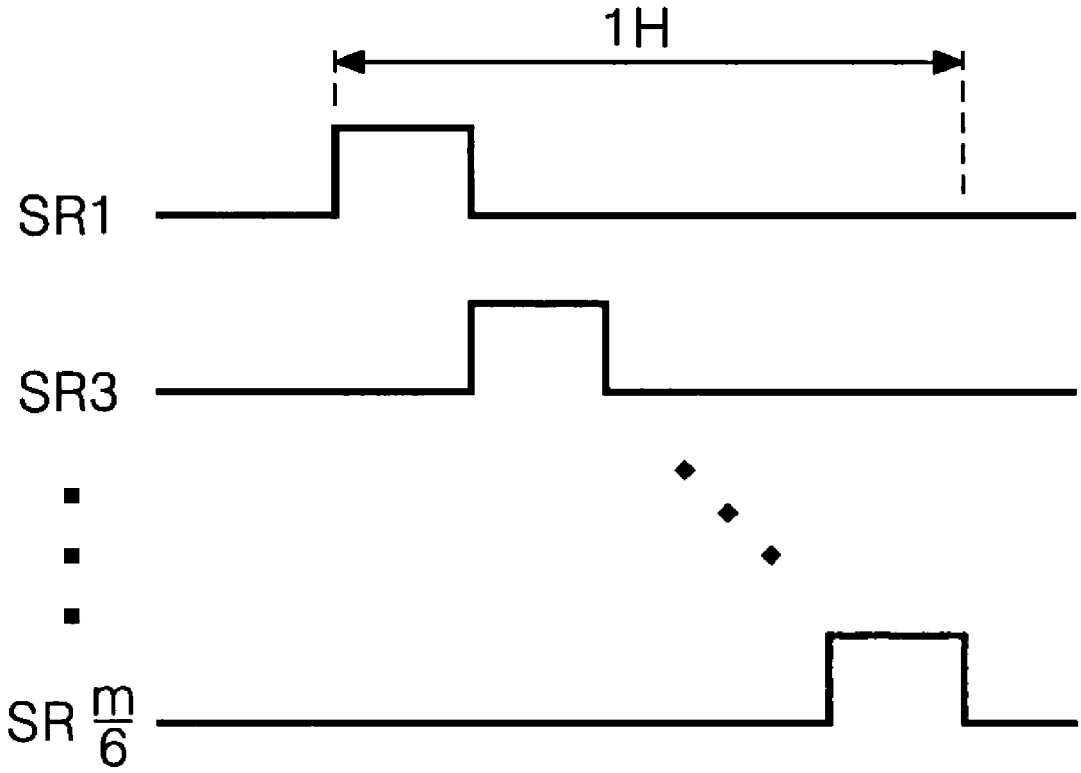
FIG. 10 is a waveform diagram showing an output of the shift register in FIG. 7.

A first through a sixth sampling control signal SR1 through SR6 sequentially generated from the shift register 226 are supplied to the gate electrodes of the second set of NMOS transistors NM21 through NM26. The source electrodes of each of the NMOS transistors of the second set of NMOS transistors NM21 through NM26 are connected to a corresponding drain electrode of each of the NMOS transistors of the first set of NMOS transistors NM11 through NM16 on a one-to-one relationship. The drain electrodes of each of the NMOS transistors NM21 through NM26 are connected to the 6 lines of the data lines DL1 through DL6 on a one-to-one relationship. The 6 lines of the second set of NMOS transistors NM21 through NM26 are simultaneously turned-on according to the output SR1 through SRm/6 of the shift register 226 in FIG. 10 to simultaneously sample the 6 lines of the analog data and to supply the sampled data to the 6 lines of the data lines DL1 through DL6.

In the output of the shift register 226, the 6 lines of the analog data are sampled by each sampling part 225, so that the pulse width enlarges approximately 6 times in comparison to the related art.

Voltages added to the analog data voltages outputted by the first NMOS transistor of the first set of NMOS transistors NM11 of each D/A converter 224 are supplied to the (6i+1)th (where i is greater than 0) data lines DL1, DL7, . . . DLm−5, and voltages added to the analog data voltages outputted from the second NMOS transistor of the first set of NMOS transistors NM12 are supplied to the (6i+2)th data lines DL2, DL8, . . . DLm−4. Likewise, voltages added to the analog data voltages outputted from the third NMOS transistor of the first set of NMOS transistors NM13 are supplied to the (6i+3)th data lines DL3, DL9, . . . DLm−3, and voltages added to the analog data voltages outputted from the fourth NMOS transistor of the first set of NMOS transistors NM14 are supplied to the (6i+4)th data lines DL4, DL10, . . . DLm−2. Lastly, voltages added to the analog data voltages outputted from the fifth NMOS transistor of the first set of NMOS transistors NM15 are supplied to the (6i+5)th data lines DL5, DL11, . . . DLm−1 and voltages added to the analog data voltages outputted from the sixth NMOS transistor of the first set of NMOS transistors NM16 are supplied to the (6i+6)th data lines DL6, DL12, . . . DLm.

The sampling part 225 samples simultaneously the 6 lines of the analog data, so that the analog data is supplied to the data lines DL1 through DLm during an approximately 6 times longer time in comparison to the related art.

As described above, a driving apparatus divides one decoded data into m number of data and samples them simultaneously, thus the sampling frequency can be greatly reduced to one time when sampling the m number of the data. Accordingly, the supply time of the data supplied to the data lines can be greatly increased.

Figure 11:
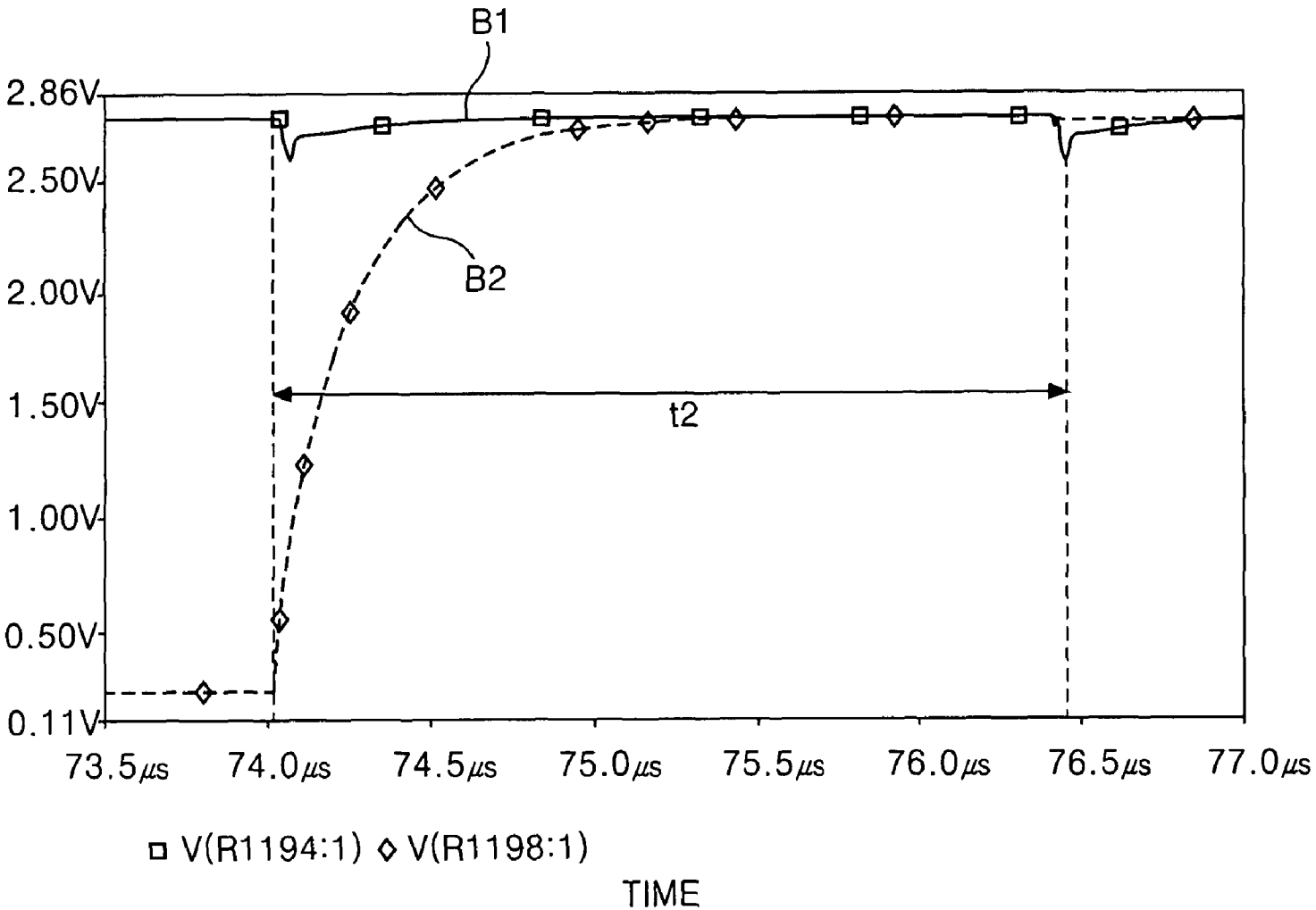
FIG. 11 is a diagram of a data supply time of the data driver included in the driving apparatus of the liquid crystal display device shown in FIG. 6.

Referring to FIG. 11, the sampling times of the m numbers of the data are reduced to greatly increase the data supply time t2. Hence, the data supply B2 sufficiently keeps up with the output B1 of the D/A converter 224. In this manner, the charging time of each pixel formed in the liquid crystal display panel 110 is sufficiently increased, and thus, the desired data can be correctly supplied to each data line. Accordingly, it is possible to prevent distortion on the screen.

As described above, a driving apparatus divides one decoded data into m number of data and samples them simultaneously, thus the data supply time supplied to the data lines can be greatly increased. Accordingly, it is possible to prevent distortion on the screen.

Although the apparatus has been explained by the examples shown in the drawings described above, it should be understood to the ordinary skilled person in the art that the disclosure is not limited thereto, but that various changes or modifications thereof are possible. Accordingly, the scope of the disclosure can be determined by referring to the appended claims and their equivalents.

What is claimed is:

1. An apparatus for driving a liquid crystal display device, comprising:

a liquid crystal display panel where a plurality of data lines are formed;

a controlling means coupled with the liquid crystal display panel for controlling division and latching of data and for controlling the sampling of the divided data; and a data driving part coupled with the controlling means that divides input digital data into a plurality of digital data under control of the controlling means, converts the plurality of the latched digital data into a plurality of analog data, and then simultaneously sampled the plurality the analog data to supply the data lines, wherein the data driving part includes a decoder operative to decode the input digital data, a dividing part coupled with the decoder and that divides the decoded digital data into the plurality of digital data in accordance with a corresponding plurality of division control signals supplied from the controlling means, a latcher coupled with the dividing part that latches the plurality of divided digital data to produce the plurality of latched digital data, a D/A converter coupled with the latcher that converts the plurality of latched digital data into the plurality of analog data and a sampling unit coupled with the D/A converter that simultaneously samples the plurality of analog data in accordance with a sampling control signal supplied from the controlling means, wherein the dividing part includes a first plurality of switching devices that switch the decoded digital data sequentially turned on by the plurality of division control signals to the latcher, and the first plurality of switching devices include a plurality of PMOS transistors turned on by the plurality of division control signals, respectively, wherein the D/A converter includes a two plurality of switching devices turned on by the plurality of digital data latched by the latcher that simultaneously switch the plurality of analog data, wherein the DAC comprises a plurality of D/A converter parts, wherein each D/A converter part of the plurality of D/A converter parts has a relative common resistor between each D/A converter part.

2. The driving apparatus according to claim 1, wherein the latcher includes:

a switching part that simultaneously switches the plurality of digital data divided by the first plurality of switching devices in response to the plurality of division control signals;

a first inversion part that inverts the levels of the plurality of switched digital data and coupled with the switching part; and a second inversion part that inverts the levels of the plurality of inverted digital data and coupled with the first inversion part.

3. The driving apparatus according to claim 2, wherein the switching part includes:

a third plurality of switching devices turned on by the plurality of division control signals that respectively switch the plurality of digital data divided by the first plurality of switching devices.

4. The driving apparatus according to claim 3, wherein the first inversion part includes:

a first plurality of inverters that respectively inverts the levels of the plurality of digital data which are simultaneously switched by the third plurality of switching devices.

5. The driving apparatus according to claim 4, wherein the second inversion part includes:

a second plurality of inverters that respectively inverts the levels of the plurality of digital data which are inverted by the first plurality of inverters.

6. The driving apparatus according to claim 1, wherein the sampling part includes:

a fourth plurality of switching devices turned on by the sampling control signal that simultaneously switch the plurality of analog data switched by the third plurality of switching devices to supply the data lines.

7. A driving apparatus according to claim 1, wherein the dividing part is further operative to sequentially repeat as an output each of the plurality of decoded digital data.

8. An apparatus for driving a liquid crystal display device, comprising:

a decoder that decodes input digital data;

a dividing part coupled with the decoder that divides the decoded digital data into a plurality of digital data in accordance with a plurality of division control signals and coupled with the decoder;

a latcher coupled with the dividing part that latches the plurality of divided digital data and couples with the dividing part;

a D/A converter coupled with the latcher that converts the plurality of latched digital data into a plurality of analog data and couples with the latcher; and a sampling part that simultaneously samples the plurality of analog data in accordance with a sampling control signal, wherein the dividing part includes a first plurality of switching devices that switch the decoded digital data sequentially turned on by the plurality of division control signals to the latcher, and the first plurality of switching devices include a plurality of PMOS transistors turned on by the plurality of division control signals, respectively, wherein the latcher includes a switching part that simultaneously switches the plurality of digital data divided by the first plurality of switching devices in response to a division control signal of the plurality of division control signals, and the switching part includes a second plurality of switching devices turned on by a last division control signal of the plurality of division control signals that respectively switch the plurality of digital data divided by the first plurality of switching devices, wherein the D/A converter includes a third plurality of switching devices turned on by the plurality of digital data latched by the latcher that simultaneously switch the plurality of analog data, wherein the DAC comprises a plurality of D/A converter parts, wherein each D/A converter part of the plurality of D/A converter parts has a relative common resistor between each D/A converter part.

9. The driving apparatus according to claim 8, wherein the latcher further includes:

a first inversion part that inverts the levels of the plurality of switched digital data and couples with the switching part; and a second inversion part that inverts the levels of the plurality of inverted digital data and couples with the first inversion part.

10. The driving apparatus according to claim 8, wherein the first inversion part includes:

a first plurality of inverters that respectively invert the levels of the plurality of digital data which are simultaneously switched by the second plurality of switching devices.

11. The driving apparatus according to claim 10, wherein the second inversion part includes:

a second plurality of inverters that respectively invert the levels of the plurality of digital data which are inverted by the first plurality of inverters.

12. The driving apparatus according to claim 8, wherein the sampling part includes:

a fourth plurality of switching devices turned on by the sampling control signal that simultaneously switch the plurality of analog data switched by the third plurality of switching devices to supply a plurality of data lines.

13. A driving apparatus according to claim 8, wherein the dividing part is further operative to sequentially repeat as an output each of the plurality of decoded digital data.

14. A method for driving a liquid crystal display device, comprising:

decoding input digital data by a decoder;

dividing the decoded digital data into a plurality of digital data using a dividing part coupled with the decoder;

latching the plurality of divided digital data by a latcher coupled with the dividing part;

converting the plurality of latched digital data into a plurality of analog data by a D/A converter coupled with the latcher; and sampling simultaneously the plurality of converted analog data to supply a plurality of data lines formed in a liquid crystal display panel, wherein the decoded digital data is divided into a plurality of digital data in accordance with a division control signals, wherein the dividing part includes a first plurality of switching devices that switch the decoded digital data sequentially turned on by the plurality of division control signals to the latcher, and the first plurality of switching devices include a plurality of PMOS transistors turned on by the plurality of division control signals, respectively, wherein the latcher includes a switching part that simultaneously switches the plurality of digital data divided by the first plurality of switching devices in response to a division control signal of the plurality of division control signals, and the switching part includes a second plurality of switching devices turned on by a last division control signal of the plurality of division control signals that respectively switch the plurality of digital data divided by the first plurality of switching devices, wherein the D/A converter includes a third plurality of switching devices turned on by the plurality of digital data latched by the latcher that simultaneously switch the plurality of analog data, wherein the DAC comprises a plurality of D/A converter parts, wherein each D/A converter part of the plurality of D/A converter parts has a relative common resistor between each D/A converter part.

15. The method according to claim 14, wherein the sampling simultaneously the plurality of converted analog data comprises providing a plurality of sampling parts, where the input terminals of the sampling parts are coupled with the outputs of a the D/A converter.

16. The method according to claim 15, wherein the sampling simultaneously the plurality of converted analog data comprises providing each sampling part with a time difference between each other sampling part.

17. The method according to claim 16, further comprising sequentially driving the sampling parts.

* * * * *